United States Patent [19]

Ito et al.

[11] 4,186,289

[45] Jan. 29, 1980

[54] CONTACT CLIP FOR SWITCH

[75] Inventors: Katsuo Ito; Yukio Kudoh, both of Kanazawa, Japan

[73] Assignee: Murata Manufacturing Co., Ltd., Kyota, Japan

[21] Appl. No.: 904,809

[22] Filed: May 11, 1978

[51] Int. Cl.[2] ..... H01H 1/00

[52] U.S. Cl. ..... 200/284; 339/275 B

[58] Field of Search ..... 200/DIG. 42, 282, 284, 200/292; 339/275 R, 275 B, 275 T, 218 R, 218 M, 217 J

[56] References Cited

U.S. PATENT DOCUMENTS 3,118,998 1/1964 Mastney et al. ..... 200/284

*Primary Examiner*—Harry N. Haroian

*Attorney, Agent, or Firm*—Birch, Stewart, Kolasch & Birch

[57] ABSTRACT

A contact clip for a switch for dip soldered connection with lead wires of electrical components and for connecting the lead wires with a switch contact comprises a resilient plate having a fold portion at one end and a pair of facially superimposed layers bent midway at a right angle, whereby a terminal portion is formed between the fold portion and the right angle bend portion and a mounting portion is formed outwardly of the right angle bend portion, while the facially superimposed layers are terminated at the end in cooperating resilient jaws for connecting the clip to the switch contact. The terminal portion is provided at the opposite side edges of one layer opposite the mounting portion with wings extending in the same direction opposite to the mounting portion. Two cuts are formed spaced apart from each other, each extending from one wing through the said one layer to the other wing and an area of the one layer defined by the two cuts is bent away from the other layer to define an elongated socket for receiving the lead wires of electrical components.

3 Claims, 5 Drawing Figures

CONTACT CLIP FOR SWITCH

BACKGROUND OF THE INVENTION

1. Field of the Invention

The present invention relates to a contact clip for a switch. More specifically, the present invention relates to an improved socket structure formed at a terminal portion of a contact clip so as to receive and mount, through dip soldering, lead wires of electrical components to be connected to the contact clip.

2. Description of the Prior Art

A contact clip is utilized in a rotary switch, for example, to constitute a stationary contact. In such a rotary switch, a rotor is rotatably provided on a rotary shaft so as to be rotated in an intermittent manner by means of a click stop mechanism and movable contacts are provided along the periphery of the rotor. The rotor is adapted such that the same is rotated while the movable contacts are each sandwiched by a pair of tip ends formed in cooperating resilient jaws of the stationary contacts. Usually a plurality of such stationary contacts are provided along the periphery of the rotor. As a result, as the rotor is rotated, selective electrical connection states can be achieved between the movable and the stationary contacts, whereby a circuit connection is suitably switched.

As briefly described in the foregoing, a plurality of contact clips are provided on a suitable base plate so as to be arranged along the periphery of a rotor in association with movable contacts provided on the rotor. Mounting of the contact clips is achieved by fixing, for example, riveting fastening and so on a mounting portion of the contact clip to a switch base plate. One end of the contact clip is formed as a sandwiching portion in cooperating resilient jaws adapted for sandwiching with a pair of tip end jaws thereof, a movable contact of the rotor. On the other hand, the opposite end of the contact clip is formed as a terminal portion including a socket structure adapted for receiving lead wires of electrical components such as coils to be connected thereto. The lead wires as accepted in the socket structure are fixed by dip soldering.

A contact clip of interest to the present invention is disclosed in U.S. Pat. No. 3,118,998, entitled "SWITCH CONTACT STRUCTURE" and issued Jan. 21, 1964 to E. J. Mastney et al. The referenced United States Patent discloses a contact clip for a switch for dip soldered connection with lead wires and for connecting the lead wires with a switch contact, comprising a resilient body having a fold portion at one end and a pair of facially superimposed layers bent midway at a right angle, whereby a terminal portion is formed between the fold portion and the right angle bend portion and a mounting portion is formed outwardly of the right angle bend portion, while the facially superimposed layers are terminated at the end in cooperating resilient jaws for connecting the clip to the switch contact, wherein the terminal portion is provided at opposite side edges of one layer opposite to the mounting portion with the wings extending in the same direction opposite to the mounting portion to define an elongated socket for receiving the lead wires. The reference contact clip, however, is less advantageous in dip soldered connection and expensive in cost. Thus, there is room for improvement.

Another contact clip of interest to the present invention is described in Japanese Patent Publication Gazette No. 14487/1971, entitled "SLIDING CONTACT" and published Mar. 31, 1971 to Hitachi Ltd. The referenced Japanese Patent Publication Gazette describes a contact clip comprising a resilient body having a fold portion at one side edge and a pair of facially superimposed layers, whereby a mounting portion for mounting the clip to the base plate is formed, which is terminated at the end in cooperating resilient jaws for connecting the clip to the switch circuit, one layer being extended at the other end to form a terminal portion. The single layered terminal portion is provided with a socket by forming a further extension to define a socket opening, cutting the single layered terminal portion per se, or the like. Again, however, the contact clip of the referenced Japanese patent publication gazette is less advantageous in that the structure is not adapted for dip soldered connection, the manufacturing process is complicated and the cost is still expensive. Thus again there is room for improvement.

Because of such solder dipping, the socket structure of the contact clip must be of a configuration and structure suited for solder dipping. It is further desired that the contact clip be of few components for reduction of cost. In addition, the socket structure is preferably large enough to be capable of accepting several lead wires of electrical components.

SUMMARY OF THE INVENTION

Briefly described, the present invention comprises a contact clip for a switch for dip soldered connection with an electrical conductor and for connecting the conductor with a switch contact, comprising a resilient body having a fold portion at one end and a pair of facially superimposed layers extending from said fold portion and defining a terminal portion adjacent said fold portion and a mounting portion extending transversely outwardly from said terminal portion and terminating at the end opposite to said terminal portion in cooperating resilient jaws, one defined by each of said layers for connecting the clip to the electrical conductor, said terminal portion having a pair of wings extending from one layer opposite to said mounting portion at said terminal portion, one wing extending from each of the opposite edges 4 said terminal portion in the same general direction, two cuts being formed spaced apart from each other, each extending from a midway position of one wing through said one layer to a midway position of the other wing, with a portion from said midway position to the side edge of each wing being left uncut, an area of said one layer and said wings defined by said two cuts being bent along the lines between said midway positions at each wing away from the other layer to define an elongated socket for receiving the electrical conductor between said area and said other layer, whereby an aperture is formed at each wing defined by said line and said other layer, which facilitates said dip soldered connection.

Preferably, a protuberance may be formed in the other layer of the terminal portion protruding toward said socket and extending in the transverse direction thereof for preventing the tip end of an electrical conductor inserted in said socket from abutting against the cut edge in each said wing. More preferably, the wings may be bent toward the socket for reinforcing the socket.

Therefore, a principal object of the present invention is to provide an improved contact clip structure for use in a switch, including a terminal portion including an improved socket structure for receiving lead wires of electrical components to be connected thereto.

Another object of the present invention is to provide an improved contact clip structure for a switch suited for solder dipping of a terminal portion including a socket structure for receiving lead wires of electrical components to be connected thereto.

A further object of the present invention is to provide an improved contact clip structure for use in a switch, including a terminal portion including a socket structure for receiving lead wires of electrical components to be connected thereto, which is easy to manufacture, and can be fabricated with a decreased number of processes and less cost of material.

Still a further object of the present invention is to provide an improved contact clip structure for use in a switch, including a terminal portion including a socket structure of a larger opening, particularly adapted for receiving an increased number of lead wires of electrical components to be connected thereto, which is most suited for a tuner of television receiver, wherein four or five lead wires must be received in the socket opening.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
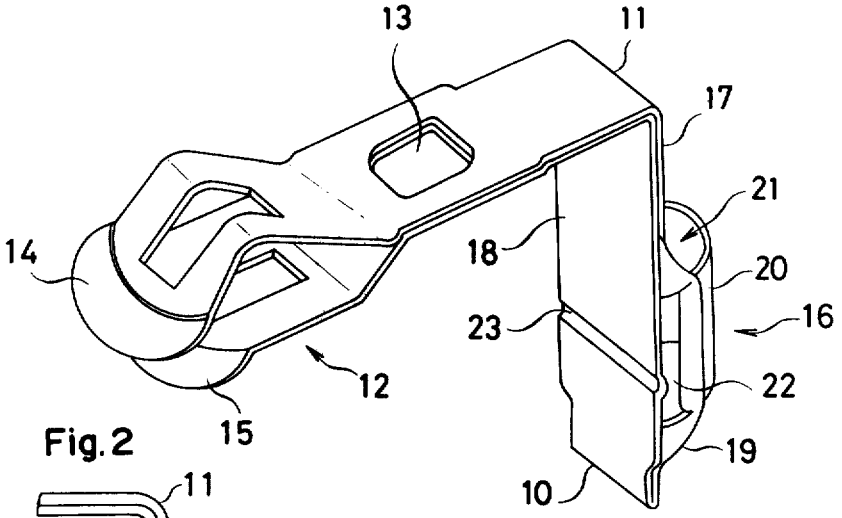
FIG. 1 shows a perspective view of one embodiment of the present invention.

Referring to FIG. 1, the contact clip shown is made of an elongated and electrically conductive blank of proper resiliency and plastic workability such as brass, phosphor bronze or the like folded at a fold line 10 running in the direction orthogonal to the longitudinal direction of the blank to provide a laminate structure of two metal layers. The above described contact clip of a laminate structure is bent at an approximate right angle at a bend line 11 running in the direction orthogonal to the longitudinal direction of the laminate structure, whereby an L letter shaped laminate structure if provided. One end of the laminate structure opposite to the folded end 10 constitutes a contact portion 12 in the form of cooperating resilient jaws for connecting the clip to a switch contact, not shown. The portion intermediate the contact portion 12 and the bend portion 11 is formed with an aperture 13 for mounting the contact clip to a switch base plate, not shown, through riveting, fastening or the like. The contact portion 12 comprises a pair of sandwiching contact jaws 14 and 15, which are concave to each other and have active jaw portions extending toward each other, normally touching at the tips.

Figure 2:
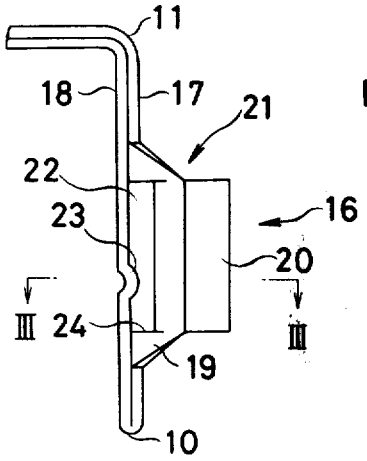
FIG. 2 is a side view of the FIG. 1 contact clip.

A socket structure 16 is formed intermediate the bend portion 11 and the fold portion 10 for fixing the lead wires of electrical components to be connected to the contact clip. The socket structure 16 will be more fully described in the following with simultaneous reference to FIG. 2 and 3 as well as FIG. 1.

Figure 3:
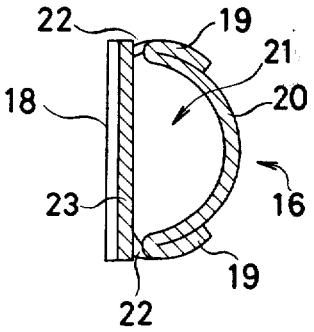
FIG. 3 shows a sectional view taken along lines III—III shown in FIG. 2.

As described previously, the contact clip is made of a two-layered laminate structure. The first metal layer 17 at the outside at the bend portion 11 is formed with a pair of wings 19 and 19 extending outwardly at the opposite side edges. The wings 19 and 19 are bent in the same direction opposite to that of the contact portion 12. Two cuts are formed spaced apart from each other, each extending in parallel with the bend portion 11 from a midway position of one wing 19 through the above described first metal layer 17 to a midway position of the other wing 19, with a portion from the said midway position to the side edge of each wing being left uncut. Then an area 20 of the above described first metal layer 17 and the above described wings 19 and 19 defined by the above described two cuts are bent along the lines between the midway positions at each wing away from the other metal layer 18, whereby a semi-cylindrical socket 21 is formed defined by a portion of a pair of the wings 19 and 19 and the bent area portion 20. According to an essential feature of the present invention, an aperture 22 is formed at each wing defined by the line running between the midway positions and the other metal layer 18, which facilitates dip soldered connection. If and when both wings 19 and 19 are bent slightly toward the first metal layer 17 before the portion 20 is bent away from the other metal layer 18, then the end portions of the wings 19 and 19 are in contact with the outer surface of the area 20 as bent, as best seen in FIG. 3, whereby the area 20 is reinforced by the bent wing end portions.

According to the embodiment shown, a protuberance 23 is formed in the other metal layer 18 so as to be protruded toward the socket and extending in the transverse direction thereto. The protuberance 23 serves to advantageously prevent the tip ends of lead wires from abutting against the cut edge formed in the wings when the lead wires of the electrical components are inserted into the socket 21.

Figure 4:
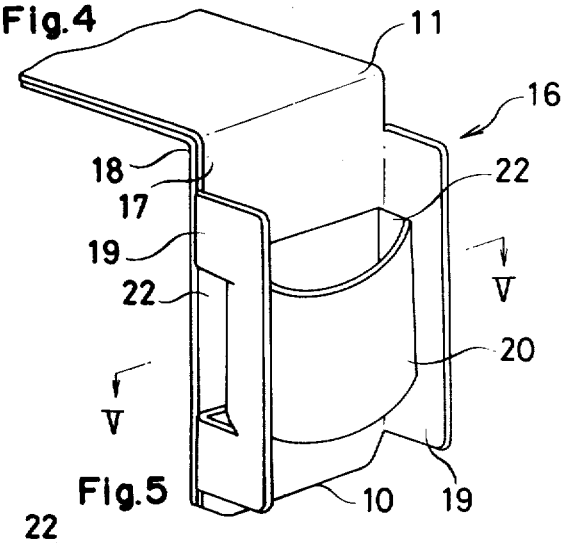
FIG. 4 shows a rear perspective view of another embodiment of the present invention.
Figure 5:
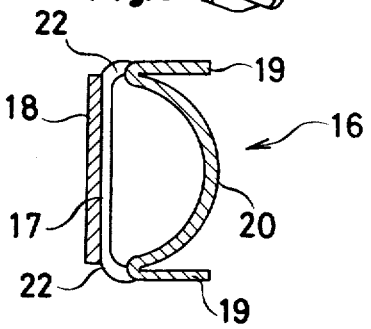
FIG. 5 shows a sectional view taken along lines V—V shown in FIG. 4.

FIG. 4 shows a perspective view of another embodiment of the inventive contact clip and FIG. 5 shows a sectional view of the FIG. 4 embodiment taken along the lines V—V in FIG. 5. The FIG. 5 embodiment is substantially the same as the FIG. 1 embodiment, except for the modifications to be described in the following. More specifically, both wings 19 and 19 are left extending in the same direction orthogonal to the plane of the first metal layer 17, without being bent along the outer surface of the bent portion 20. In addition, the protuberance 23 has not been provided. Since the other structural features of the embodiment shown in FIGS. 4 and 5 are the same as those of the embodiment shown in FIGS. 1 through 3, the same portions have been denoted by the same reference characters. Hence, it is not believed necessary to describe the same again in more detail.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A contact clip for a switch for dip soldered connection with an electrical conductor and for connecting the conductor with a switch contact, comprising: a resilient body having a fold portion at one end and a pair of facially superimposed layers extending from said fold portion and defining a terminal portion adjacent said fold portion and a mounting portion extending transversally outwardly from said terminal portion and terminating at the end opposite to said terminal portion in cooperating resilient jaws, one defined by each of said layers for connecting the clip to a said switch contact, said terminal portion having a pair of wings extending from one layer opposite to said mounting portion at said terminal portion, said wings extending one from each of the opposite edges of said terminal portion in the same general direction, two cuts being formed spaced apart from each other, each said cut extending from a midway position of one wing through said one layer to a midway position of the other wing, with a portion from said midway position to the side edge of each wing being left uncut, an area of said one layer and said wings defined by said two cuts being bent along the lines between said midway positions at each wing away from the other layer to define an elongated socket for receiving an electrical conductor between said area and said other layer, whereby an aperture is formed at each wing defined by said lines and said other layer, which facilitates said dip soldered connection.

2. A contact clip for a switch in accordance with claim 1, wherein a protuberance if formed in said other layer of the terminal portion to protrude toward said socket and extending in the transverse direction thereof for preventing the tip end of an electrical conductor inserted in said socket from abutting against the cut edges in said wings.

3. A contact clip for a switch in accordance with claim 1, wherein said wings are bent toward said bent area of said one layer and said wings defined by said two cuts for reinforcing said area.

* * * * *